US005254906A

United States Patent [19]

Kimura

[11] Patent Number: 5,254,906

[45] Date of Patent: Oct. 19, 1993

[54] PHOTOMULTIPLIER TUBE HAVING A GRID TYPE OF DYNODES

[75] Inventor: Suenori Kimura, Hamamatsu, Japan

[73] Assignee: Hamamatsu Photonics K.K., Hamamatsu, Japan

[21] Appl. No.: 744,739

[22] Filed: Aug. 14, 1991

[30] Foreign Application Priority Data

Aug. 15, 1990 [JP] Japan ..... 2-215325

[51] Int. Cl.[5] ..... H01J 43/18; H01J 43/22

[52] U.S. Cl. ..... 313/535; 313/533; 313/536; 313/104; 313/105 R

[58] Field of Search ..... 313/533, 536, 535, 104, 313/105 R

[56] References Cited

U.S. PATENT DOCUMENTS 3,579,017 5/1971 Vestal ..... 313/105
4,914,351 4/1990 Kuroda ..... 313/105 X

FOREIGN PATENT DOCUMENTS 0131339 1/1985 European Pat. Off. .
0165119 12/1985 European Pat. Off. .
0350111 1/1990 European Pat. Off. .
48408 8/1984 Japan ..... 313/533
167946 9/1984 Japan ..... 313/533

*Primary Examiner*—Palmer C. DeMeo
*Attorney, Agent, or Firm*—Sughrue, Mion, Zinn, Macpeak and Seas

[57] ABSTRACT

An electron multiplier tube including a grid type of plural dynode arrays arranged in a first direction with a multistage structure for successively multiplying electrons incident thereto and an anode provided below the multistage structure of dynode arrays for collecting the multiplied electrons to output an amplified electrical signal, each of the dynode arrays including plural rod-shaped dynode elements arranged in a second direction and a mesh electrode provided over each of the dynode arrays for providing an equipotential, wherein the multistage structure of dynode arrays includes at least one group of neighboring dynode arrays whose dynode elements are arranged so as to be aligned with one another in the first direction without displacement. Each of the dynode elements has a substantially isosceles trapezoid section, both side legs of the trapezoid being slightly inwardly curved to effectively receive the incident electrons which have been emitted from a dynode array at an upper stage.

23 Claims, 8 Drawing Sheets

PHOTOMULTIPLIER TUBE HAVING A GRID TYPE OF DYNODES

BACKGROUND OF THE INVENTION

This invention relates to an electron multiplier tube such as a photomultiplier tube, a secondary electron multiplier tube or the, like which has a grid dynode structure.

A convention photomultiplier tube is formed of electron multiplier tubes, and is utilized as a photodetector having a high sensitivity in various technical fields such as the medical field, high-energy physics, photoanalysis, biotechnology and so on.

FIG. 1 shows a typical photomultiplier tube having a box and grid combination type of dynode structure (combination of a box dynode structure and a grid dynode structure). This tube comprises a transmission type of photocathode 1 serving as a negative electrode for converting light into a stream of photoelectrons, a focusing electrode 2 for converging the photoelectron stream, plural dynodes serving as electron multiplying means 3 for multiplying the photoelectrons emitted from the photocathode 1, an anode for collecting the multiplied electrons and a vacuum envelop 5 for accommodating the above elements. In this case, the electron multiplying means 3 comprises multiple box type dynodes $6_1$ to $6_3$ at a front stage (from a first stage to a multiple third stage), and a grid type dynodes $6_4$ to $6_9$ at a rear stage (from a fourth stage to a ninth stage) which has a multistage structure. This type of photomultiplier tube is disclosed in Japanese Examined Published Patent Application No. 60-30063.

In this type of photomultiplier tube, each of the box type dynodes $6_1$ to $6_3$ has a sectoral shape in sectional profile as shown in FIG. 2. This shape corresponds to one of four sectors which are obtained by uniformly quartering a hollow cylinder in a longitudinal direction thereof. A mesh electrode 8 for providing an equipotential throughout a correct pending stage of the dynode elements is further provided over an electron incident side of each of the box type dynodes $6_1$ to $6_3$ as shown in FIG. 2.

On the other hand, each of the grid type dynodes $6_4$ to $6_9$ (hereinafter referred to as "dynode arrays") includes plural rod-shaped dynode elements 9 arranged in a predetermined direction (e.g. horizontally) and another mesh electrode 10 for providing an equipotential which is provided over an electron-incident side thereof. As shown in FIG. 3, the dynode element 9 has an isosceles trapezoid in sectional profile, both side legs of the trapezoid being slightly inwardly curved. In other words, the dynode element 9 has a konide-like sectional shape having inwardly-curved (or concave) side lines (hereinafter referred to as "modified konide-shape"). The inwardly-curved side surfaces of each rod-shaped dynode element 9 enables an effective reception of electrons which are emitted from a dynode element at an upper stage. The grid type dynode arrays thus constructed are laminated to form a multistage structure as shown in FIG. 3.

Conventionally, the grid type dynode arrays $6_4$ to $6_9$ are wobblingly arranged in a laminating direction of the dynode arrays $6_4$ to $6_9$ (hereinunder referred to as "wobbling arrangement"). In detail, dynode elements 9 at an upper (previous) stage are arranged in a direction vertical to the laminating direction (or horizontally) at a predetermined interval, and dynode elements at a lower (next) stage (located just below the previous stage) are horizontally disposed at positions corresponding to gaps between the dynodes at the previous stage. That is, the dynode array at the next stage is positionally displaced to the dynode array at the previous stage. This arrangement is applied to the subsequent grid type dynodes at the subsequent stages. A plate-shaped dynode $6_{10}$ is provided at the last stage, and an anode 4 for collecting electrons multiplied at the upper dynode stages is provided between the plate-shaped dynode $6_{10}$ and the dynode array $6_9$ located above the plate-shaped dynode $6_{10}$. That is, the "wobbling arrangement" means that the dynode arrays at the neighboring stages are alternately positionally displaced to each other in the laminating direction at a distance (substantially at a half pitch of the dynode elements at each stage).

This wobbling arrangement of the multistage dynodes has been conventionally required to attain the following objects.

A first object is to increase an effective area of the dynodes for receiving the electrons which have been emitted from the box type of dynodes $6_1$ to $6_3$ to prevent the electrons emitted from the box type dynodes from passing through the grid type dynodes without impinging on the dynode elements. A second object is to prevent an ion feedback effect. The electrons impinging on a dynode element 9 in one stage frequently produce ions such as oxygen ions, and the ions travel upwardly toward other dynode elements in other stages located above the first stage. The impingement of the ions and the dynode elements causes emission of secondary electrons. Therefore, the electrons impinging on a dynode element 9 produce not only an output peak which is originated from these electrons, but it also produces a secondary output peak which is originated from the ions. The latter output peak is produced with a delay time with respect to the production of the former output peak, and this delayed production of the electrons causes noise. Further, if a large number of ions are produced they damage the photocathode. The wobbling arrangement of the dynode arrays can prevent the produced ions from travelling toward, the dynode elements in upper stages because the ions produced in one stage, which attempt to travel to upper stages through gaps between the dynode elements, are shielded by the bottoms of the dynode elements which are located above the stage and in the gaps.

However, sufficient multiplication has not been obtained in the conventional photomultiplier tube as described above because the grid type dynodes $6_4$ to $6_9$ have a low multiplication factor (gain) for secondary electrons. In order to heighten the gain for the secondary electrons, a first proposal is to apply a high voltage between neighboring dynode arrays to heighten an emission factor of secondary electrons. A second proposal is to increase a number of stages to be laminated to thereby heighten a whole multiplication factor (gain) of the grid type dynodes.

The following disadvantages occur for the first proposal. The secondary electron emission factor is saturated if a voltage to be supplied to the dynode arrays is above a predetermined voltage, and in addition a high voltage damages a voltage-resistance capability of the dynodes. On the other hand, the following disadvantages occur for the second proposal. The multiplying portion or means must be wholly designed in large size, and thus a voltage to be supplied must be larger. Further, an interval between neighboring dynode stages is beforehand determined, and thus the number of the dynode arrays to be accommodated in the envelope 5 is limited to a predetermined number.

Through various experimental processes, it has been found that the conventional photomultiplier tube having the wobbling arrangement as shown in FIG. 4 has the following characteristics.

When dynode elements 9 at a next (just lower) stage are located so as to confront gaps 11 between dynode elements 9 at a previous (just upper) stage, respectively, as shown in FIG. 4, it is seemingly expected that most of secondary electrons emitted from each dynode element 9 at the previous stage would be caught by (impinge on) the dynode elements 9 at the next stage, and thus contribute to emission of secondary electrons at the next stage. However, according to an experiment, it is assured that the secondary electrons emitted from the dynode elements 9 at the previous stage frequently penetrate through the next stage without impinging on the dynode elements at the next stage, and impinges, for example, on the further lower stages subsequent to the next stage.

FIG. 5 is a graph showing an experimental result of a distribution ratio of secondary electrons emitted from the dynode array at the fourth stage to the fifth and subsequent stages.

A solid line (characteristic line) B of FIG. 5 represents an electron distribution ratio of the conventional grid type of dynodes having the wobbling arrangement in which dynode elements at even stages are disposed in such a manner as to confront gaps between dynode elements at odd stages. As is apparent from the characteristic line B, the secondary electrons emitted from the fourth dynode array $6_4$ impinge on each of the dynode arrays $6_6$ and $6_7$ at the sixth and seventh stages in higher electron distribution ratio (electron-incidence rate) than on the dynode array $6_5$ at the fifth stage. This result indicates that most of the secondary electrons do not impinge on the dynode elements at the next (just lower) stage, but penetrate therethrough to the dynode elements at the further lower stages, and thus the multiplication factor (gain) is lower in such a wobbling arrangement.

SUMMARY OF THE INVENTION

An object of this invention is to provide a photomultiplier tube having a sufficient multiplication factor (gain) for secondary electrons without applying a higher voltage to dynode elements and without increasing a number of dynode stages.

In order to attain the above object, an electron multiplier tube according to this invention comprises multiple dynode arrays arranged at a first pitch in a first direction with a multistage structure for successively multiplying electrons incident thereto. An anode is provided below the multistage structure of the dynode arrays for collecting the multiplied electrons to output an amplified electrical signal. Each of the dynode arrays comprises plural rod-shaped dynode elements arranged at a second pitch in a second direction and a mesh electrode provided over each of the dynode arrays for providing an equipotential. The multistage structure of dynode arrays includes at least one group of neighboring dynode arrays whose dynode elements are arranged so as to be aligned with one another in the first direction without, displacement. Each of the dynode elements has a substantially isosceles trapezoid section, both side legs of the trapezoid being slightly inwardly curved to effectively receive the incident electrons which have been emitted from a dynode array at an upper stage.

The dynode elements of each of the dynode arrays may be arranged in the second direction in a grid form, a mesh form, or a honeycombed form. The box type dynodes may be omitted and circular cage type dynodes, line focus dynodes or venetian type dynodes substituted therefore.

BRIEF DESCRIPTION OF THE INVENTION

FIG. 10 illustrates a mesh arrangement of the dynode arrays;

FIG. 11 illustrates a honeycomb arrangement of the dynode arrays;

FIG. 12 illustrates a side-on type circular cage shaped photomultiplier;

FIG. 13 illustrates a head-on type circular cage shaped photomultiplier;

FIG. 14 illustrates a linearly focused type photomultiplier; and

FIG. 15 illustrates a venetian blind type photomultiplier.

DETAILED DESCRIPTION OF THE INVENTION

A preferred embodiment of this invention will be described hereunder with reference to the accompanying drawings.

Figure 6:
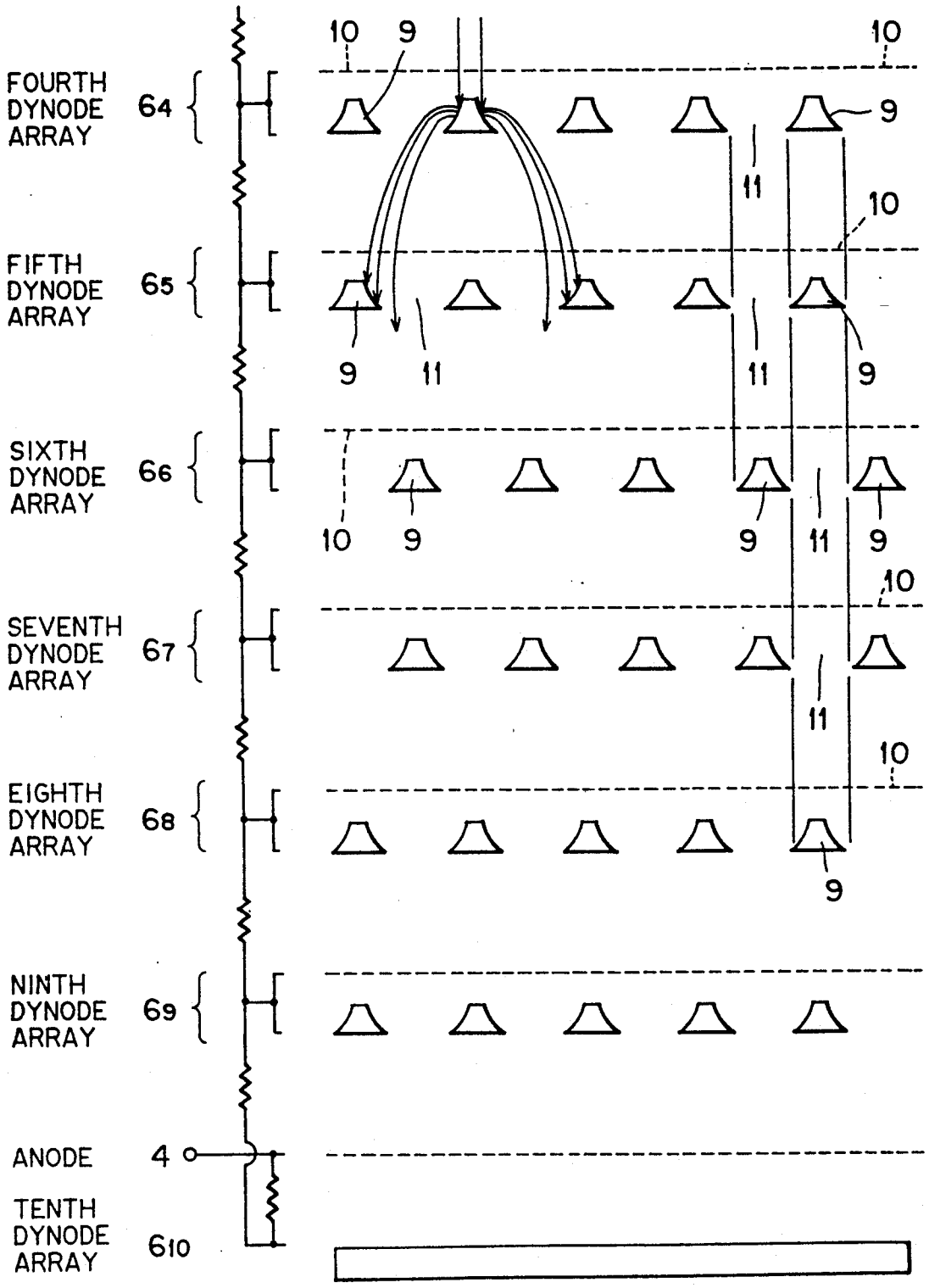
FIG. 6 shows a first embodiment of a modified wobbling arrangement which is adopted in the photomultiplier tube according to this invention.

FIG. 6 shows a first embodiment a grid type of dynodes serving as a part of the electron multiplying means used in a photomultiplier tube according to this invention. These grid type the dynodes are, structurally the same as those of FIG. 4 except for the specific arrangement of the dynodes. Therefore, the detailed description of the same elements are eliminated from the following description.

Figure 1:
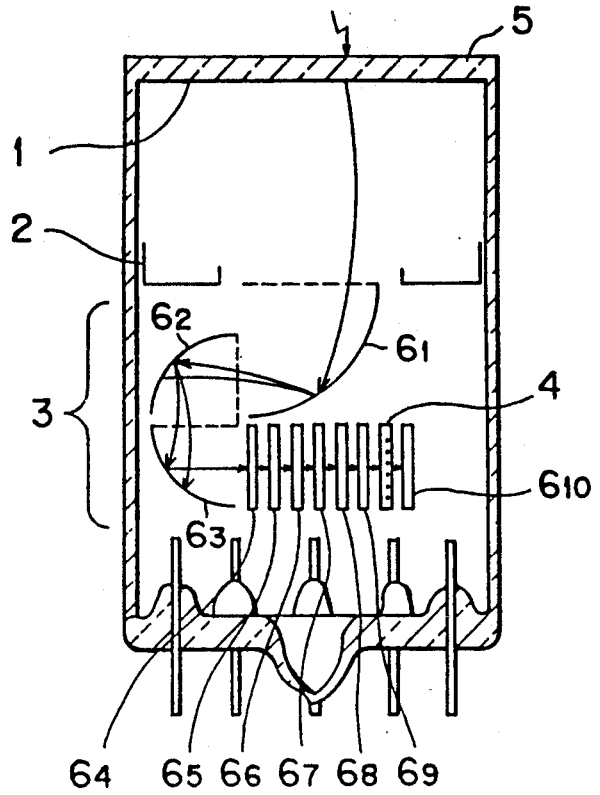
FIG. 1 PRIOR ART
FIG. 1 is a schematical view of a conventional photomultiplier tube.
Figure 2:
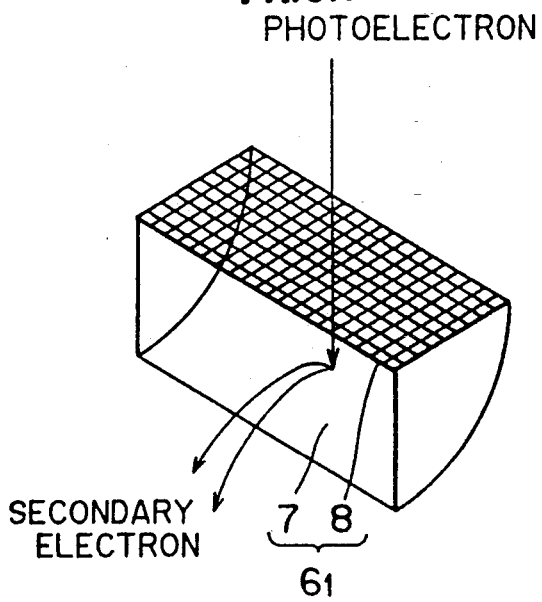
FIG. 2 PRIOR ART
FIG. 2 is a perspective view of a box type of dynode.
Figure 3:
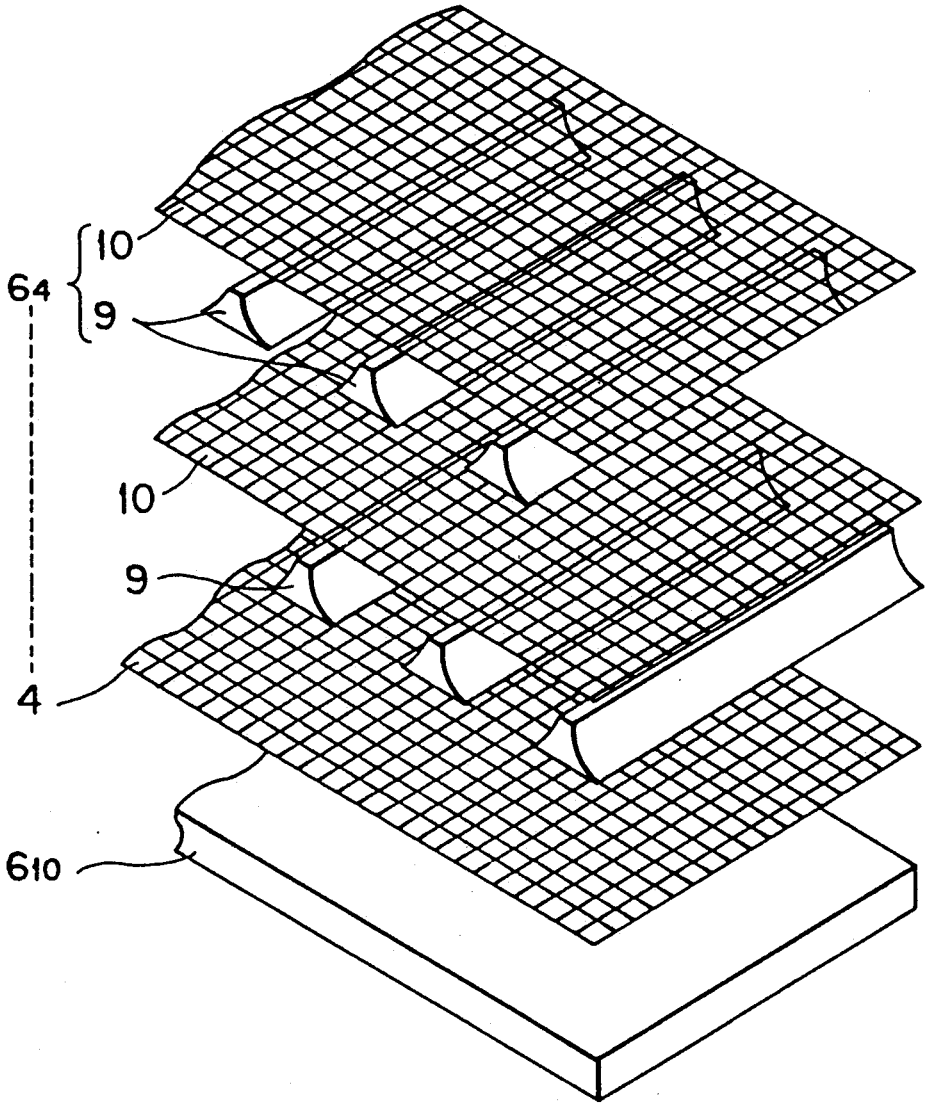
FIG. 3 PRIOR ART
FIG. 3 is a schematic view of a grid type of dynode arrays.
Figure 4:
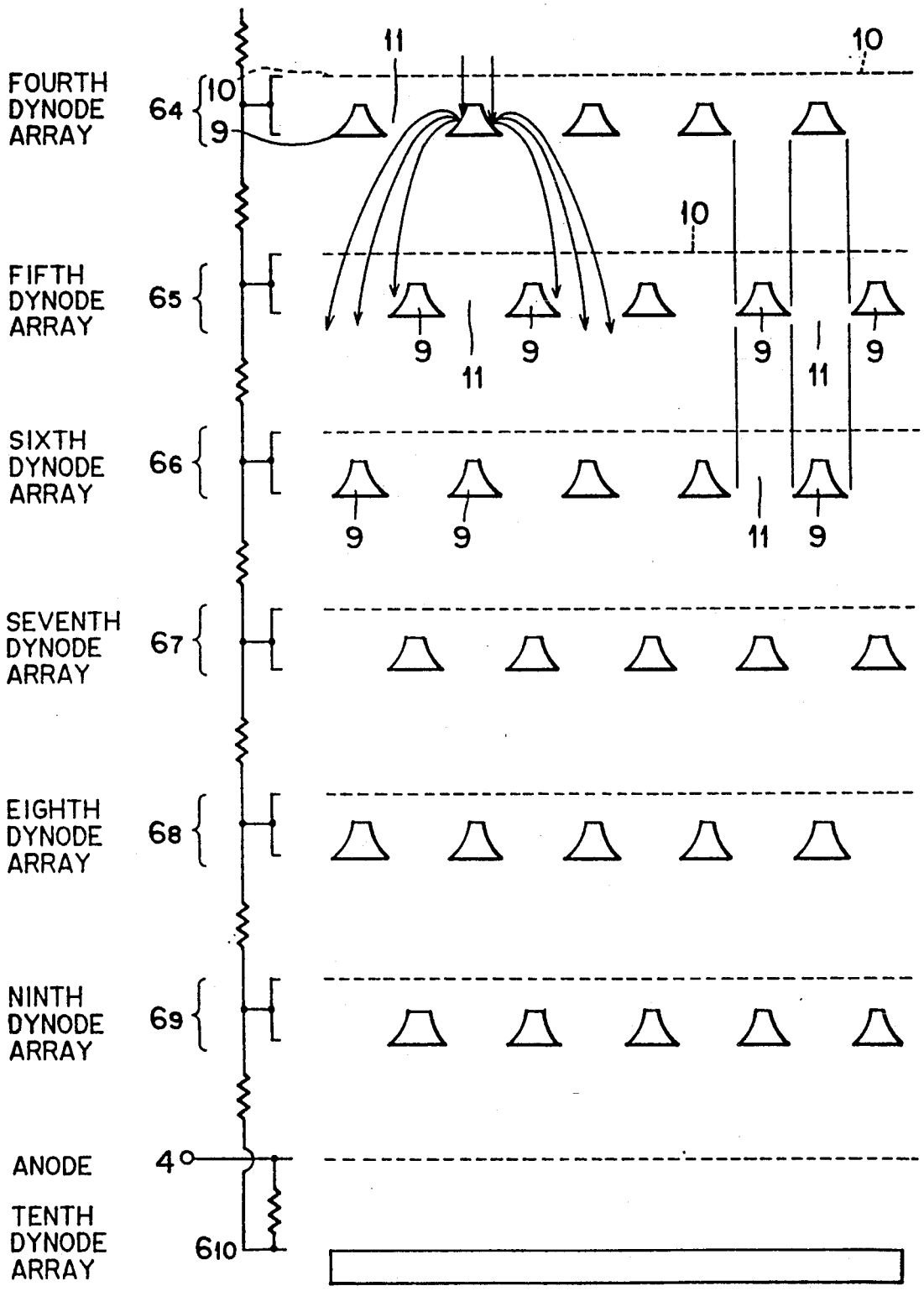
FIG. 4 PRIOR ART
FIG. 4 shows a wobbling arrangement of dynode arrays which is adopted in the conventional photomultiplier tube.

The photomultiplier tube according to this invention has substantially the same construction as that of FIG. 1, and includes a transmission type of photocathode 1, a focusing electrode 2, box type dynodes $6_1$ to $6_3$ at the front stage, grid type dynode arrays $6_4$ to $6_9$, an anode 4, a plate-shaped dynode $6_{10}$ and a vacuum envelope 5. Like the grid type dynodes having the wobbling arrangement as shown in FIG. 4, the dynode arrays $6_4$ to $6_9$ at fourth to ninth stages, the anode 4 and the plate-shaped dynode $6_{10}$ at the last stage are arranged at predetermined intervals in the laminating direction of the dynode arrays. In addition, each dynode array at each stage also comprises plural rod-shaped dynode elements 9 arranged at a predetermined pitch in a predetermined direction (horizontally) and a mesh electrode 10 for providing an equipotential. Each dynode element 9 has an isosceles trapezoid in sectional profile, both side legs (lines) of the trapezoid being slightly inwardly curved to effectively receive incident electrons which have been emitted from a dynode array at an upper stage. In other words, the dynode element 9 has a konide-like sectional shape having inwardly-curved (or concave) side lines (a modified konide-like shape).

However, unlike the wobbling arrangement of the dynode arrays as shown in FIG. 4, the grid type dynodes according to this embodiment include at least one pair of neighboring dynode arrays whose dynode elements are arranged so as to be aligned with each other without displacement in the laminating direction thereof.

In the first embodiment of the grid type dynodes as shown in FIG. 6, both groups of dynode elements 9 of the fourth and fifth dynode arrays $6_4$ and $6_5$ are disposed substantially on the same columns (on the same vertical lines), respectively. Similarly, two pairs of neighboring dynode arrays $6_6$ and $6_7$, and $6_8$ and $6_9$ are disposed such that the dynode elements 9 of each pair are disposed substantially on the same columns (on the same vertical lines), respectively. This arrangement of dynode elements in the neighboring dynode arrays are hereinafter referred to as the "straight arrangement". On the other hand, the dynode arrays $6_5$ and $6_6$ (and $6_7$ and $6_8$) are wobblingly arranged such that the dynode elements 9 thereof are displaced to each other like the conventional grid type dynodes.

When the photomultiplier tube including the grid type dynodes thus constructed (that is, the grid type dynodes having a modified wobbling arrangement) are actuated, the photocathode 1, the focusing electrode 2, the first to tenth dynodes (or dynode arrays) $6_1$ to $6_{10}$ and the anode 4 are supplied with, for example, 0, 200, 300, 400, 500, 600, 700, 800, 900, 1000, 1100, and 1200 volts, respectively.

A photomultiplying operation of the photomultiplier tube of this embodiment will be described hereunder.

Upon incidence of light into a position on the photocathode 1, photoelectrons are emitted from the incident position on the photocathode 1. The photoelectrons are convergently directed to the first dynode $6_1$ of the box type dynodes by the focusing electrode 2. Upon incidence of the photoelectrons to the first dynode $6_1$, secondary electrons are emitted from an incident position on the first dynode $6_1$ to the next (second) dynode $6_2$ to be mulitiplied with an secondary electron emission effect of the dynodes. The secondary electron emission (multiplying) process is repeated in the next (third) dynode $6_3$, and the electrons thus multiplied are supplied to the grid type dynodes (dynode arrays) $6_4$ to $6_{10}$, and then outputted from the anode 4.

As described above, the grid type dynodes of this embodiment include three pairs of neighboring dynode arrays. The dynode elements 9 of each pair are arranged on the same columns (on the same vertical lines). This modified wobbling arrangement effectively performs the incidence of the secondary electrons from the fourth dynode array $6_4$ to the fifth dynode array $6_5$, the incidence of the secondary electrons from the sixth dynode array $6_6$ to the seventh dynode array $6_7$, and the incidence of the secondary electrons from the eighth dynode array $6_8$ to the ninth dynode array $6_9$, and thus improves the multiplication factor (gain) more sufficiently.

Figure 5:
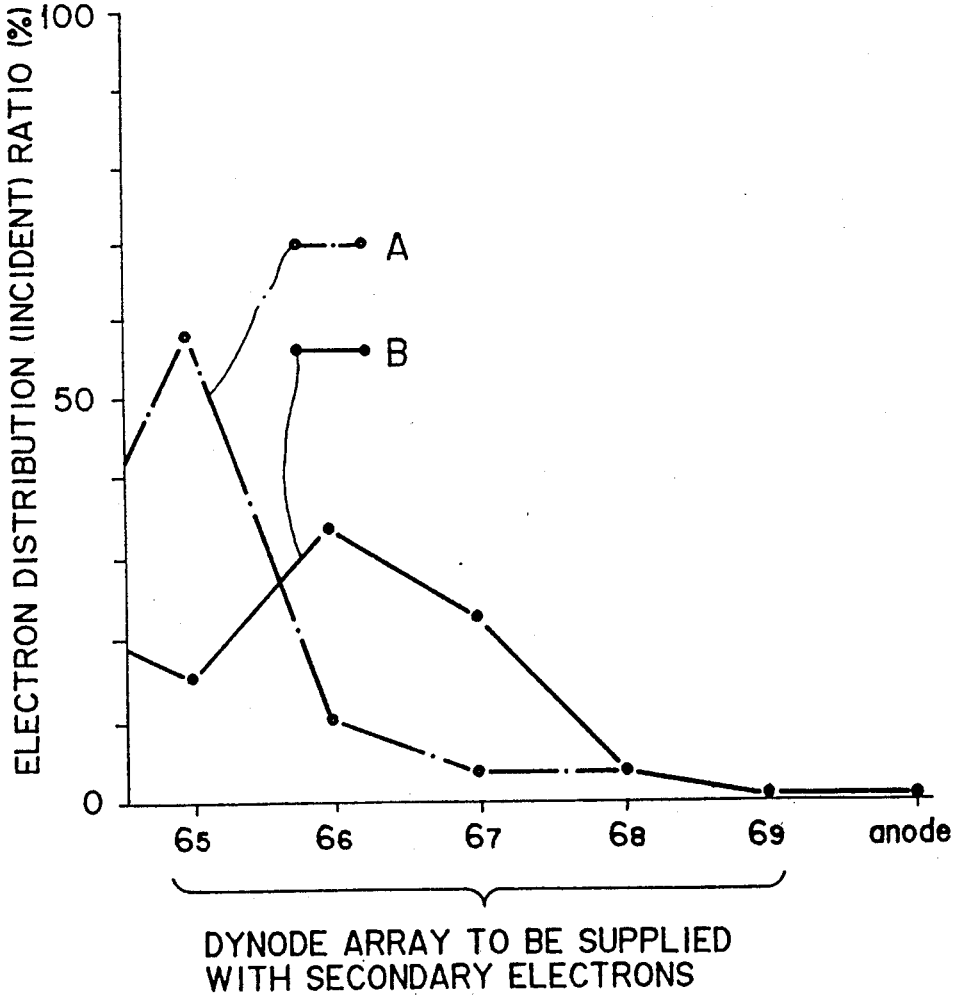
FIG. 5 is a graph showing an electron distribution ratio to each dynode array.

A dotted line A in FIG. 5 represents an electron distribution (incidence) ratio of the grid type dynodes having a modified wobbling arrangement in which the dynode elements 9 of the fourth and fifth dynode arrays $6_4$ and $6_5$ are disposed so as to be confronted to each other (that is, with no displacement). According to the line A, most of the secondary electrons which have been emitted from the fourth dynode array $6_4$ are incident to the dynode elements 9 of the fifth dynode array $6_5$, and thus there is little possibility that the secondary electrons emitted from the fourth dynode array $6_4$ are passed through the fifth dynode array $6_5$ without impinging on the fifth dynode array $6_5$ and incident to the sixth or subsequent dynode array. In this case, the dynode arrays $6_5$ and $6_6$ ($6_7$ and $6_8$) are wobblingly arranged, so that the ion feedback affection is prevented.

In the first embodiment, three pairs of dynode arrays each of which has two dynode arrays having the straight-line arrangement, are wobblingly arranged (alternately displaced to one another). That is, the dynode elements of each pair are arranged with no displacement, but the pairs themselves are wobblingly arranged. This arrangement is hereinafter referred as the "two-two wobbling arrangement".

The arrangement of the grid type of dynodes according to this invention is not limited to the "two-two wobbling arrangement", but any modification may be made.

Figure 7:
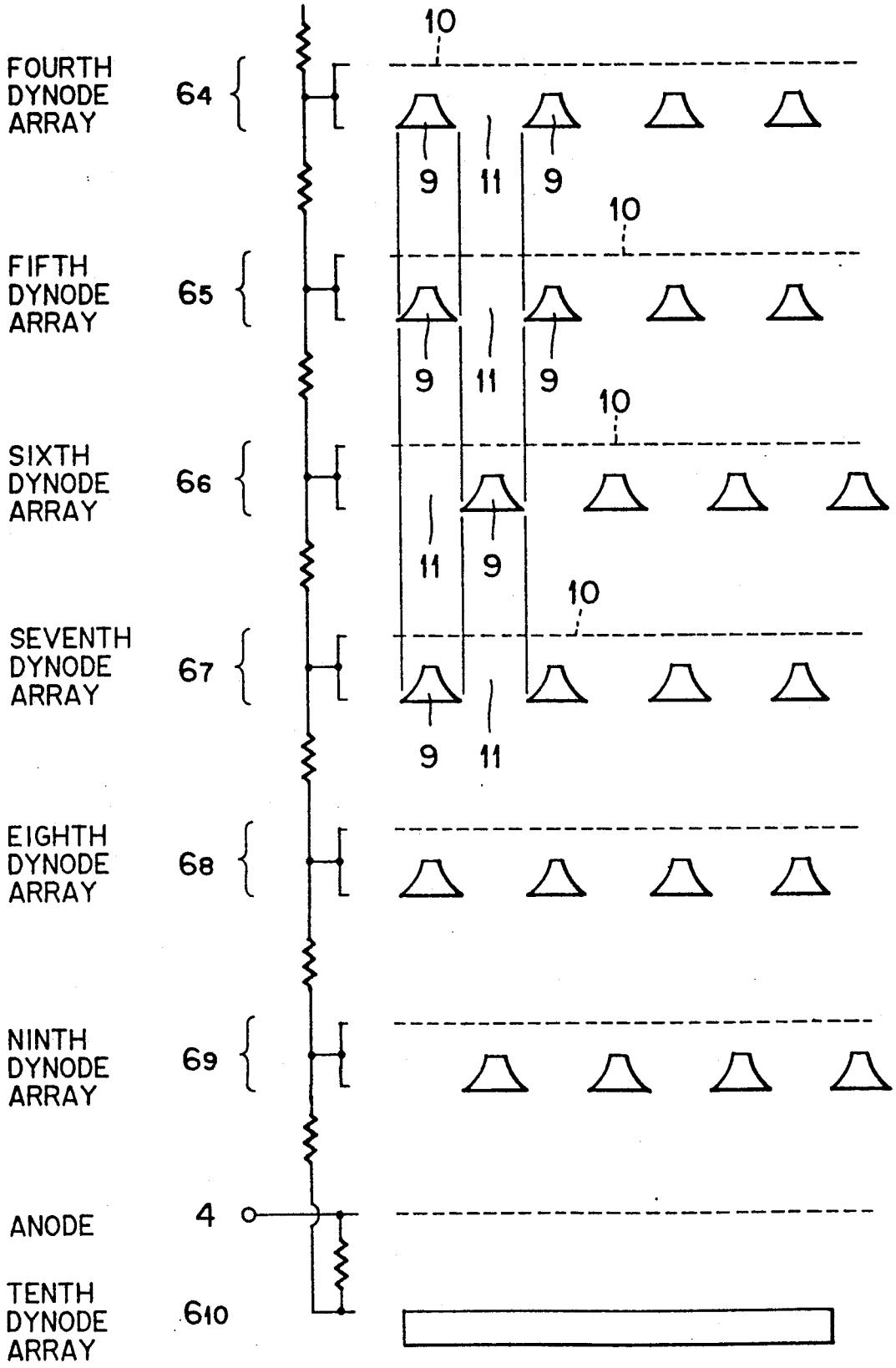
FIG. 7 shows a second embodiment of the modified wobbling arrangement which is adopted in the photomultiplier tube according to this invention.

FIG. 7 shows a second embodiment of the grid type dynodes according to this invention.

In this embodiment, one dynode array is provided between two pairs of neighboring dynode arrays each of which has two dynode arrays having the "straight arrangement" in such a manner as to be displaced (wobblingly disposed) with respect to each of the pairs of the dynode arrays. This arrangement is hereinafter referred to as "two-one wobbling arrangement".

Figure 8:
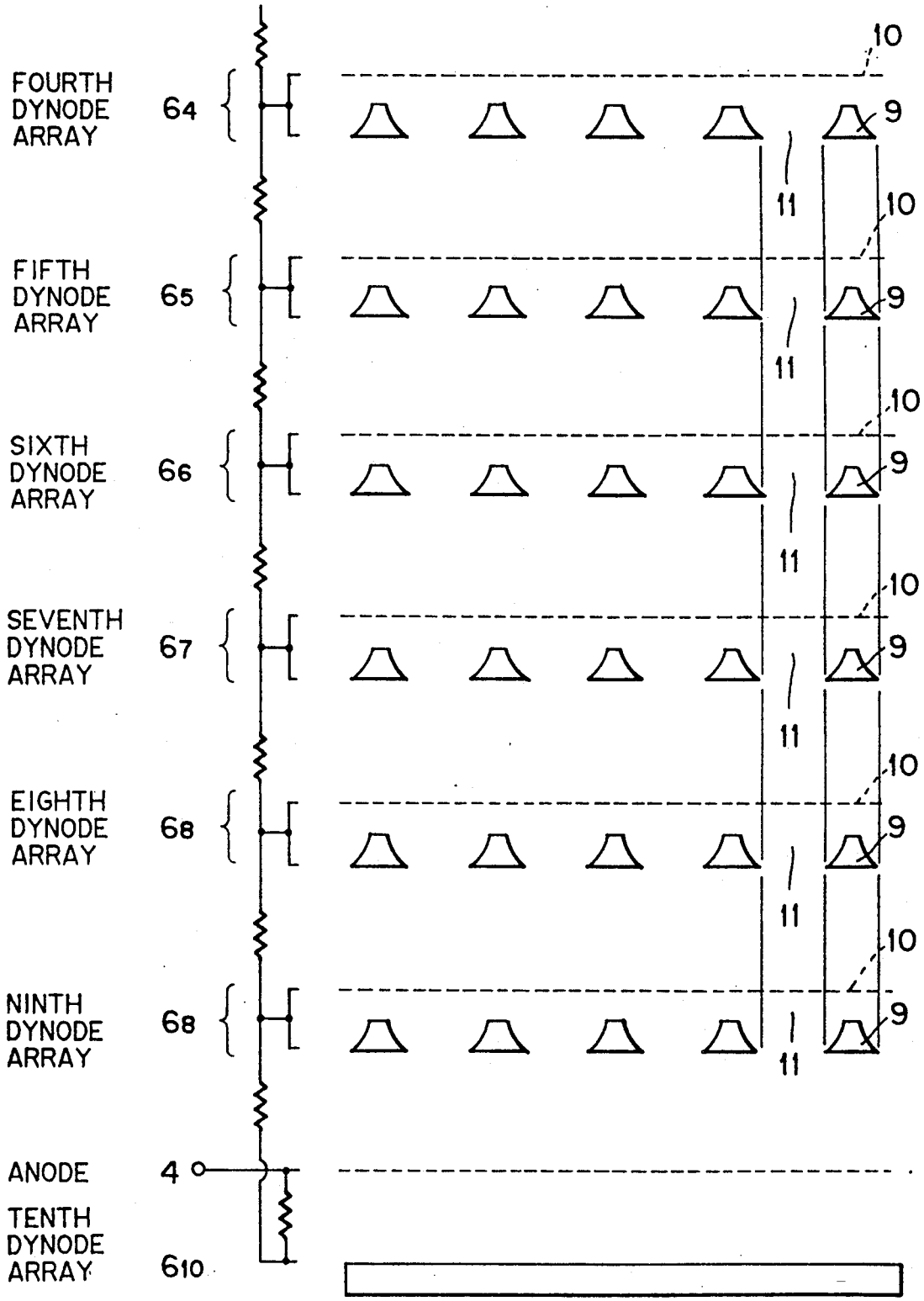
FIG. 8 shows a third embodiment of the modified wobbling arrangement which is adopted in the photomultiplier tube according to this invention.

FIG. 8 shows a third embodiment of the grid type dynodes according to this invention.

In this embodiment, all of the dynode arrays $6_4$ to $6_9$ are arranged with no displacement, that is, the dynode elements 9 of all the dynode arrays are disposed substantially on the same columns (on the same vertical lines). In this case, there occurs a problem that the ion feedback can not be prevented. However, the secondary electrons are most effectively multiplied. This arrangement is hereinafter referred to as "matrix arrangement".

In addition to the "two-two wobbling arrangement", "two-one wobbling arrangement", and "matrix arrangement" as described above, for example, "three-one wobbling arrangement", "four-one wobbling arrangement", . . . , "three-three wobbling arrangement", "four-four wobbling arrangement",. . . , "n-m wobbling arrangement" may be adopted where n and m are integers. That is, at least one pair of neighboring dynode arrays are arranged straightforwardly in a laminating direction of the dynode arrays (electron multiplying direction) such that the dynode elements of these dynode arrays seems to be overlapped to one another when seen along the laminating direction of the dynode arrays.

Figure 9:
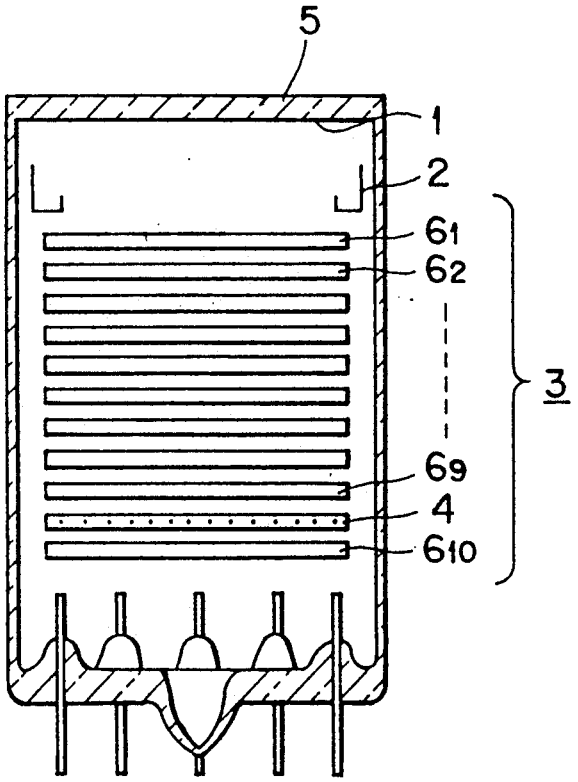
FIG. 9 is a schematic view of another photomultiplier tube having only a grid type of dynode arrays according to this invention.

In the above embodiments, the first to third dynodes serving as a box type of dynodes and the fourth to ninth dynode arrays serving as a grid type dynodes are used in combination. However, the electron multiplying means of this invention is not limited to the above embodiments. For example, as shown in FIG. 9, only a grid type of dynodes can be used as the electron multiplying means. Further, a combination of a grid type and one or more of a circular cage type, a line focusing type and a Venetian blind type may be adopted.

The number of the dynode stage of the dynode arrays are not limited to that of the above embodiments, and may be two or more dynode stages two of which are arranged with no displacement. Further, the photocathode may be of a transmission type or a reflection type.

In the above embodiments, each dynode array comprises plural rod-shaped dynode elements which are parallel arranged at a predetermined pitch, however, the horizontal arrangement of the dynode elements of each dynode array is not limited to this embodiment. These dynode elements may be arranged in a mesh form or a honeycombed form such that rod-shaped members serving as dynode elements are intersected to one another.

The above embodiments are described in a case where the grid type of dynodes having a modified wobbling arrangement is applied to the photomultiplier tube, however, the same effect can be obtained in a case where they are applied to other types of electron multiplier tubes such as a secondary electron multiplier tube.

As described above, the grid type of dynodes according to this invention includes at least one pair of neighboring dynode arrays whose dynode elements are disposed straightforwardly in the multiplication direction without displacement, so that the electron multiplication factor(gain) can be improved without increasing voltages to be supplied to the dynodes and without incrementing the number of dynode arrays.

In a comparative experiment using a photomultiplier tube to which the grid type of dynodes having the wobbling arrangement as shown in FIG. 4 and the grid type of dynodes having the two-two wobbling arrangement as shown in FIG. 6 are provided, the photomultiplier tube of this invention has an increase of the multiplication factor (gain) by 3.18 times in comparison with the conventional photomultiplier tube. Further, in another comparative experiment using a photomultiplier tube to which the grid type of dynodes having the wobbling arrangement as shown in FIG. 4 and the grid type of dynodes having the matrix arrangement as shown in FIG. 8 are equipped, the photomultiplier tube of this invention has an increase of the multiplication factor (gain) by 5.04 times. Here, an experimental data for each of the photomultiplier tubes of this invention and the prior art is an average value of 10 samples which are manufactured under the same condition. In this experiment, the dimension of a Konide-like section of each dynode element 9 is as follows: the top width is 0.13 to 0.18 mm; the bottom width, 0.48 to 0.5 mm; and the height, 0.25 mm. Further, a pitch between neighboring dynode elements is 0.5 mm, and a gap interval between neighboring dynode arrays is 1.25 mm. Distances between the bottom of each dynode element 9 and a mesh electrode 10 just below the dynode element 9 and between the top of each dynode element 9 and a mesh electrode 10 just above the dynode element 9, are 0.87 mm and 0.25 mm, respectively.

What is claimed is:

1. An electron multiplier tube comprising:

a plurality of spaced dynode arrays arranged in a first direction, each of said dynode arrays successively multiplying electrons incident thereto, and an anode provided below said plurality of dynode arrays for collecting the multiplied electrons to output an amplified electrical signal, each of said dynode arrays comprising:

a plurality of rod-shaped dynode elements arranged in a second direction which extends perpendicularly to the first direction, and a mesh electrode, positioned adjacent said plurality of rod-shaped elements, for providing an equipotential throughout the corresponding plurality of rod-shaped dynode elements, wherein said plurality of dynode arrays include at least two dynode arrays positioned next to each other in the first direction which are arranged such that each of the plurality of rod-shaped dynode elements in one of said at least two dynode arrays is aligned, along a plane extending in said first direction, with corresponding dynode elements in another one of said at least two dynode arrays, wherein each of the plurality or rod-shaped dynode elements in one of the two dynode arrays is aligned, along a plane extending in one of the two dynode arrays is aligned, along a plane extending the said first direction, with corresponding dynode elements in said another one of said two dynode arrays and wherein all of sad plurality of dynode arrays are arranged such that corresponding rod-shaped dynode elements in every dynode array are aligned with one another along planes extending in the first direction.

2. An electron multiplier tube as claimed in claim 1 wherein each of said dynode elements has a substantially isosceles trapezoid cross section, in which both side legs of the trapezoid are slightly inwardly curved to effectively receive the incident electrons which have been emitted from a dynode array at an upper stage.

3. An electron multiplier tube comprising:

a plurality of spaced dynode arrays arranged in a first direction, each of said dynode arrays successively multiplying electrons incident hereto, and an anode provided below said plurality of dynode arrays for collecting the multiplied electrons to output an amplified electrical signal, each of said dynode arrays comprising:

a plurality of rod-shaped dynode elements arranged in a second direction which extends perpendicularly to the first direction, and a mesh electrode, proximate said plurality of rod-shaped elements, for providing an equipotential through the corresponding plurality of rod-shaped dynode elements, wherein said plurality of dynode arrays are arranged to construct a dynode array group, said dynode array group being formed of at least two dynode arrays which are positioned next to each other in the first direction and which are arranged such that each rod-shaped dynode element in one of the two dynode arrays is aligned, along a plane extending in the first direction, with a corresponding dynode element in the other one of said two dynode arrays.

4. An electron multiplier tube as claimed in claim 3, wherein all of said dynode arrays are arranged to construct a single dynode array group in which corresponding rod-shaped dynode elements in every dynode array are aligned with one another along planes extending in the first direction.

5. An electron multiplier tube as claimed in claim 3, wherein said plurality of dynode arrays are arranged to construct a plurality of dynode array groups, each of the dynode array groups including at least two dynode arrays which are positioned next to each other in the first direction and which are arranged such that each rod-shaped dynode element in one of the two dynode arrays is aligned, along a plane extending in the first direction, with a corresponding dynode element in the other one of the two dynode arrays.

6. An electron multiplier tube as claimed in claim 3, wherein the plural dynode array groups are arranged such that corresponding rod-shaped dynode elements of respective dynode array groups are aligned with respect to one another in planes extending in the first direction.

7. An electron multiplier tube as claimed in claim 3, wherein two dynode array groups, arranged adjacent to each other along the first direction, are arranged to sandwich a single dynode array therebetween in the first direction, each of the rod-shaped dynode elements in the single dynode array being off-set with respect to corresponding dynode elements in the dynode arrays of the two dynode array groups.

8. An electron multiplier tube as claimed in claim 3, wherein dynode array groups are arranged in the first direction such that respective rod-shaped dynode elements of a first dynode array group are off-set with respect to corresponding rod-shaped dynode elements of a second dynode array group which is arranged in the first direction and which is adjacent to said first dynode array group.

9. An electron multiplier tube as claimed in claim 3, wherein each of said dynode elements has a substantially isosceles trapezoid cross section, in which both side legs of the trapezoid are slightly inwardly curved to effectively receive the incident electrons which have been emitted from a dynode array at an upper stage.

10. An electron multiplier tube comprising:

a plurality of spaced dynode arrays arranged in a multistage structure, each of said dynode arrays successively multiplying electrons incident thereto, and an anode provided below said plurality of dynode arrays for collecting the multiplied electrons to output an amplified electrical signal, each of said dynode arrays comprising:

a plurality of rod-shaped dynode elements, and a mesh electrode, positioned adjacent said plurality of rod shaped elements, for providing an equipotential throughout the corresponding plurality of rod-shaped dynode elements, wherein said plurality of dynode arrays include at least first and second dynode arrays, which are arranged such that dynode elements in said first dynode array are aligned with corresponding dynode elements in said second dynode array and wherein said plurality of dynode arrays includes third and fourth dynode arrays, each of which includes a plurality of dynode elements, said dynode elements in said third dynode array being aligned with corresponding dynode elements in said fourth dynode array, said dynode elements in said third dynode array being off-set with respect to corresponding dynode elements in said second dynode array.

11. The electron multiplier tube as claimed in claim 10, wherein each of said dynode elements has a substantially isosceles trapezoid cross section, in which both side legs of the trapezoid are slightly inwardly curved to effectively receive incident electrons which have been emitted from a dynode array at an upper stage.

12. The electron multiplier tube as claimed in claim 10, further comprising a plate-shaped dynode provided below said anode.

13. The electron multiplier tube as claimed in claim 10, wherein each of said dynode arrays, said anode and said plate-shaped dynode are supplied with stepwisely-increased voltages in this order.

14. The electron multiplier tube as claimed in claim 10, wherein said first and second dynode arrays are disposed at a front side of the multistage structure.

15. The electron multiplier tube as claimed in claim 10, wherein all dynode arrays in said plurality of dynode arrays are arranged such that all dynode elements therein are aligned with corresponding dynode elements from an adjacent dynode array.

16. The electron multiplier tube as claimed in claim 10, wherein said plurality of dynode arrays includes fifth and sixth dynode arrays, each of which includes a plurality of dynode elements, said dynode elements in said fifth dynode array being aligned with corresponding dynode elements in said sixth dynode array, said dynode elements in said fifth dynode array being off-set with respect to corresponding dynode elements in said fourth dynode array.

17. An electron multiplier tube comprising:

a plurality of spaced dynode arrays arranged in a multistage structure each of said dynode arrays successively multiplying electrons incident thereto, and an anode provided below said plurality of dynode arrays for collecting the multiplied electrons to output an amplified electrical signal, each of said dynode arrays comprising:

a plurality of rod-shaped dynode elements, and a mesh electrode, positioned adjacent a plurality of rod shaped elements, for providing an equipotential throughout the corresponding plurality of rod-shaped dynode elements, wherein said plurality of dynode arrays include at least first and second dynode arrays, which are arranged such that dynode elements in said first dynode array are aligned with corresponding dynode elements in said second dynode array and wherein said plurality of dynode arrays includes a third dynode array, which includes a plurality of dynode elements, said dynode elements in said third dynode array being off-set with respect to dynode elements in said second dynode array.

18. The electron multiplier tube as claimed in claim 17, wherein said dynode elements in each of said dynode arrays are arranged in a grid form, a mesh form, or a honeycombed form.

19. The electron multiplier tube as claimed in claim 17, further comprising any one selected from the group consisting of a box type of dynodes, a circular cage type of dynodes, a line focus type of dynodes and a Venetian type of dynodes which are provided in front of said multistage structure of dynode arrays.

20. The electron multiplier tube as claimed in claim 17, wherein the dynode elements in each of said dynode arrays are linearly arranged in a single plane.

21. The electron multiplier tube as claimed in claim 17, further comprising a photocathode for converting light into photoelectrons, a focusing electrode for converging the photoelectrons into said grid type of dynode arrays, thereby to convert the light into an amplified electrical signal.

22. The electron multiplier tube as claimed in claim 17, wherein said plurality of dynode arrays includes fourth and fifth dynode arrays, each of which includes a plurality of dynode elements, said dynode elements in said fourth dynode array being aligned with corresponding dynode elements in said fourth dynode array being aligned with corresponding dynode elements in said fifth dynode array said dynode elements in said fourth dynode array being off-set with respect to dynode elements in said third dynode array.

23. An electron multiplier tube comprising:

a plurality of spaced dynode arrays arranged in a first direction, each of said dynode arrays successively multiplying electrons incident thereto, and an anode provided below said plurality of dynode arrays for collecting the multiplied electrons to output an amplified electrical signal, each of said dynode arrays comprising:

a plurality of rod-shaped dynode elements arranged in a second direction which extends perpendicularly to the first direction, and a mesh electrode, positioned adjacent said plurality of rod-shaped elements, for providing an equipotential throughout the corresponding plurality of rod-shaped dynode elements, wherein said plurality of dynode arrays include at least two dynode arrays positioned next to each other in the first direction and are arranged such that each of the plurality of rod-shaped dynode elements in one of said at least two dynode arrays is aligned, along a plane extending in said first direction, with corresponding dynode elements in the other one of said at least two dynode arrays and wherein said plurality of dynode arrays further include two additional dynode arrays positioned next to one another in the first direction, said two additional dynode arrays being arranged such that each of the rod-shaped dynode elements in one of the two additional dynode arrays is aligned, along a plane extending in the first direction, with a corresponding dynode element in another one of the two additional dynode arrays, said two dynode arrays and said two additional dynode arrays being arranged such that each rod-shaped dynode element in the two dynode arrays is off-set with respect to a corresponding one of the rod-shaped dynode elements in the two additional dynode arrays.

* * * * *